US006412523B2

(12) United States Patent
Brozell et al.

(10) Patent No.: US 6,412,523 B2
(45) Date of Patent: Jul. 2, 2002

(54) PUMP DISPENSER HAVING BODY WITH FILL-THROUGH CONDUIT

(75) Inventors: Leonora M. Brozell, Toledo; Wing-Kwong Keung, Perrysburg; Richard D. Lohrman, Sylvania, all of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/981,303

(22) Filed: Oct. 18, 2001

Related U.S. Application Data

(62) Division of application No. 09/526,264, filed on Mar. 16, 2000, now Pat. No. 6,345,738.

(51) Int. Cl.[7] ..... B65B 1/04

(52) U.S. Cl. ..... 141/2; 141/234; 141/237; 53/97; 53/89

(58) Field of Search ..... 141/2, 18, 67, 141/234, 235, 237; 222/383.1; 53/89, 95, 96, 97

(56) References Cited

U.S. PATENT DOCUMENTS 6,345,738 B1 * 2/2002 Brozell et al. ..... 141/18

* cited by examiner

*Primary Examiner*—Steven O. Douglas

(57) ABSTRACT

This pump body is mounted on a container and has a forward manually operated pump and a rearward vertical container fill conduit. In the filling process, the container is filled through the conduit, and a closure is then applied to the top of the conduit. The closure may be part of the pump body housing. Multiple containers with their pump bodies may be filled simultaneously.

4 Claims, 4 Drawing Sheets

PUMP DISPENSER HAVING BODY WITH FILL-THROUGH CONDUIT

CROSS REFERENCE TO RELATED APPLICATIONS

This application is a divisional application of patent application Ser. No. 09/526,264 filed Mar. 16, 2000 is now U.S. Pat. No. 6,345,738.

FIELD OF THE INVENTION

This invention relates to pump dispensers of the hand held type including a pump body mounted on a container and having a manually operated trigger for powering the pump. More specifically, this invention relates to such a dispenser in which the filling of the container is done through a conduit in the pump body.

BACKGROUND OF THE INVENTION

The prior art is replete with pump dispensers of various types. These comprise pump bodies which are mounted on a supply container, the container being filled with liquid product before the pump is mounted. After the filling, the assembly of the pump onto the container is accomplished.

This procedure has involved the separate ordering, inventorying of pump and container, the filling of the container and the mounting of the pump on the filled container. Often in the filling process, the container is run along a conveyor prior to reaching the pump mounting station. If there is a mishap on the conveyor or if the filling head or container is out of line, there can be spillage with waste and mess. The installation of the pump on the filled container can also be fraught with hazards.

SUMMARY OF THE INVENTION

Under the present invention, the pump body includes not only the pump but also a fill conduit connected to the container. In the filling process, the container with pump body mounted is conveyed to a fill station wherein a fill nozzle is inserted into the fill conduit, and the container is filled. A closure is then applied to the upper end of the fill conduit.

As another way of expressing the invention, it is a hand held dispensing assembly comprising a container, a pump body secured to the container and including a forward manually operated pump having a dip tube extending into the container, and a rearward vertical fill conduit defined by an upper end and a lower end connected to the container, and a closure closing the upper end of the conduit.

Under the invention, the benefits are many. In the first place, because pump body and container are assembled before filling, there is no need for the filler to inventory separately the pumps and containers. This eliminates a serious logistic problem: making sure the pumps and containers arrive in time for the filling operation and not too far ahead of time because storage space is valuable. Further, separately moving and handling the components takes labor.

Secondly, the proper leakproof assembly of the pump body on the container is not done by the filler, but by the provider of the assemblies who is in better position to detect improper seating, cracked or deformed cartons, defective pumps, and improper torque in assembly in the case of a screw cap. Moreover, with the invention there is reduced line space, reduced capital requirement and a general reduction in inventory required and increased efficiency. Finally, the invention makes practical the simultaneous filling of assemblies arranged in an open carton.

BRIEF DESCRIPTION OF THE DRAWINGS

Further objects and features of the invention will be clear to those skilled in the art from a review of the following specification and drawings, all of which present non-limiting forms of the invention. In the drawings.

DESCRIPTION OF THE PREFERRED EMBODIMENT

Figure 1:
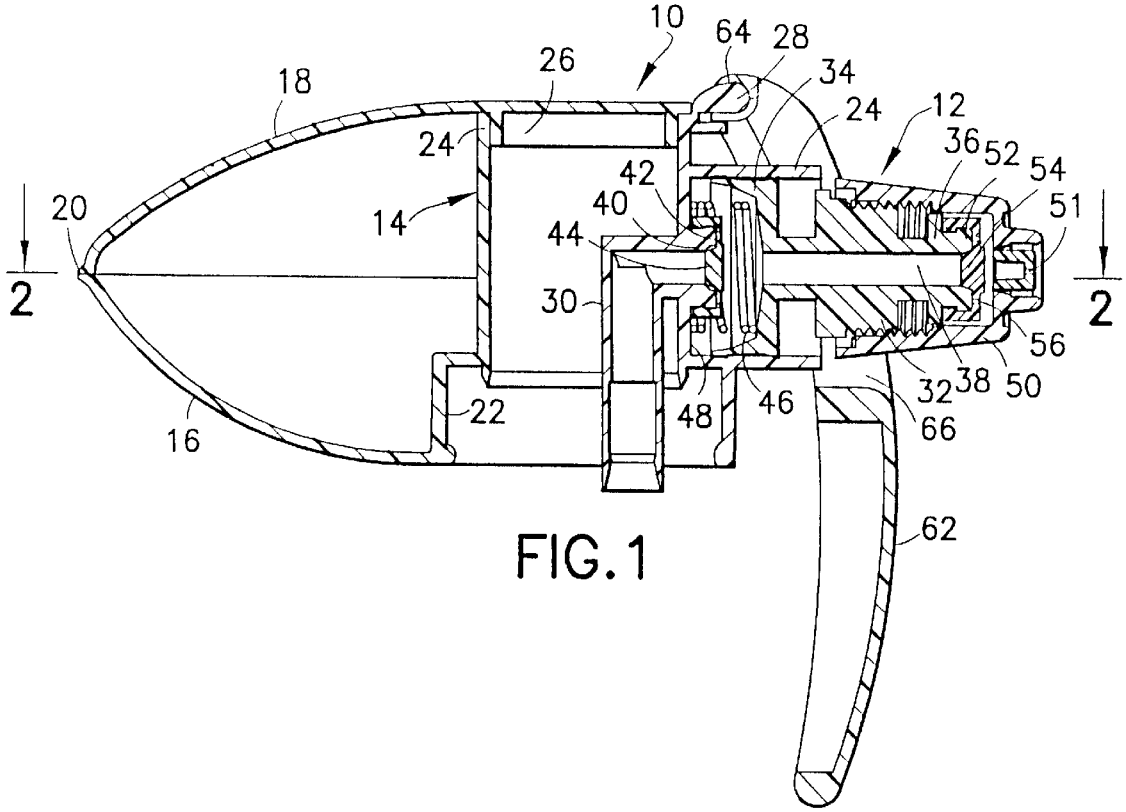
FIG. 1 is a centerline vertical sectional view of a pump body embodying the invention.

A dispenser body embodying the invention is generally designated 10 in FIG. 1. It comprises a forward pump 12 and a rearward vertical fill conduit 14.

Figure 2:
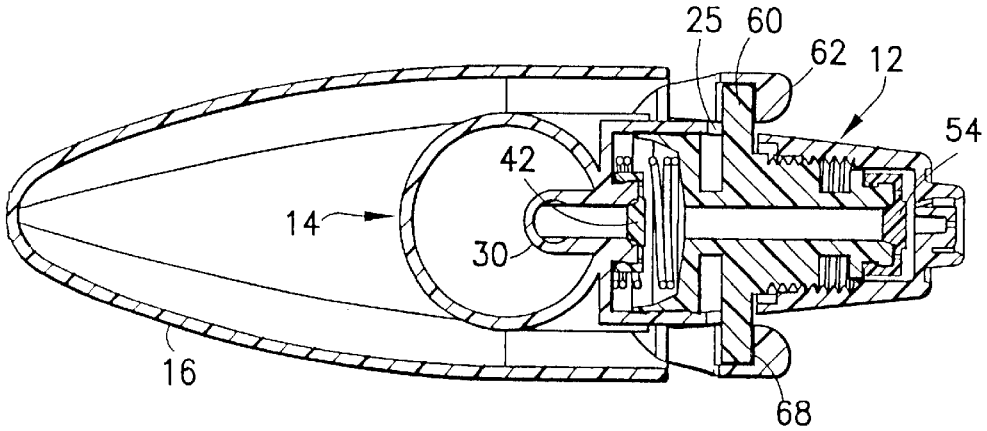
FIG. 2 is a sectional view on the line 2—2 of FIG. 1.

The body also includes a housing having a lower portion 16 and a cover or upper portion 18 which are held together by a living hinge 20. The lower housing portion 16 includes a downward circular container connection 22 (shown in the drawings as a simplified view of a bayonet fitting to cooperate with a suitable rib on the container. A threaded or other connection is, of course, contemplated.). A forwardly facing pump cylinder 24 is molded integrally with the conduit, the cylinder formed in its front end with notches 25 (FIG. 2).

The conduit 14 is integral with the container connection 22. Conduit 14 has an open upper end 24 which receives a closure 26 comprising part of the upper housing portion 18. Extending forward from the upper end 24 of the vertical conduit 14 is the trigger mount 28. A tubular dip tube mount 30 is formed integrally with the center of the pumping cylinder 24 and extends downward at a right angle (as shown in FIG. 1) into the conduit. From the mount 30 a dip tube extends into the container (not shown in FIG. 1).

The pump 12 includes a piston/nozzle unit 32. This, in turn, comprises a piston 34 and nozzle 36. The piston/nozzle unit is formed with an axial outlet passage 38, and the piston is slidably received into the cylinder 24.

The dip tube tubular mount 30 extends inward into the cylinder 24 and terminates in an enlarged head 40, and a conventional cap-shaped resilient inlet check 42 fits snugly over the head 40. Centrally the cap is formed with a valve plug 44 connected to the periphery of the cap by zig-zag spokes as is disclosed, for instance, in U.S. Pat. No. 4,358,057 to Burke. The plug 44 in the seated portion valves off the inlet flow through the mount 30 to the chamber. An axial spring 46 is disposed between the piston 34 and the back wall 48 of the cylinder urging the piston/nozzle unit outward.

A nozzle cap 50 is provided and is threaded onto the nozzle 36 as shown. The cap 50 may include a swirl chamber and orifice 51 as described in U.S. Pat. No. 4,313,568 to Shay.

At its forward end the nozzle 36 is formed with a head 52. A cap-type resilient check valve 54 preferably identical to valve 42 fits snugly over the head 52 of the nozzle and is formed with a central plug valve 56 resiliently supported by zig-zag spokes in similar fashion to the plug 44 and adapted when seated to valve off the cylinder outlet passage 38.

As shown in FIG. 2, the nozzle is formed with laterally extending trunions 60 disposed on a horizontal axis at diametrically opposite positions on the nozzle. A trigger lever 62 is secured at its upper end 64 in pivotal fashion over the mount 28. Intermediate its ends the trigger lever 62 is formed with an opening 66 to freely receive the nozzle and nozzle cap 50. Saddles 68 are formed in the sides of the trigger and receive respectively the two trunions 60 (FIG. 2). The trunions 60 are aligned with the notches 25 in the cylinder.

Figure 3:
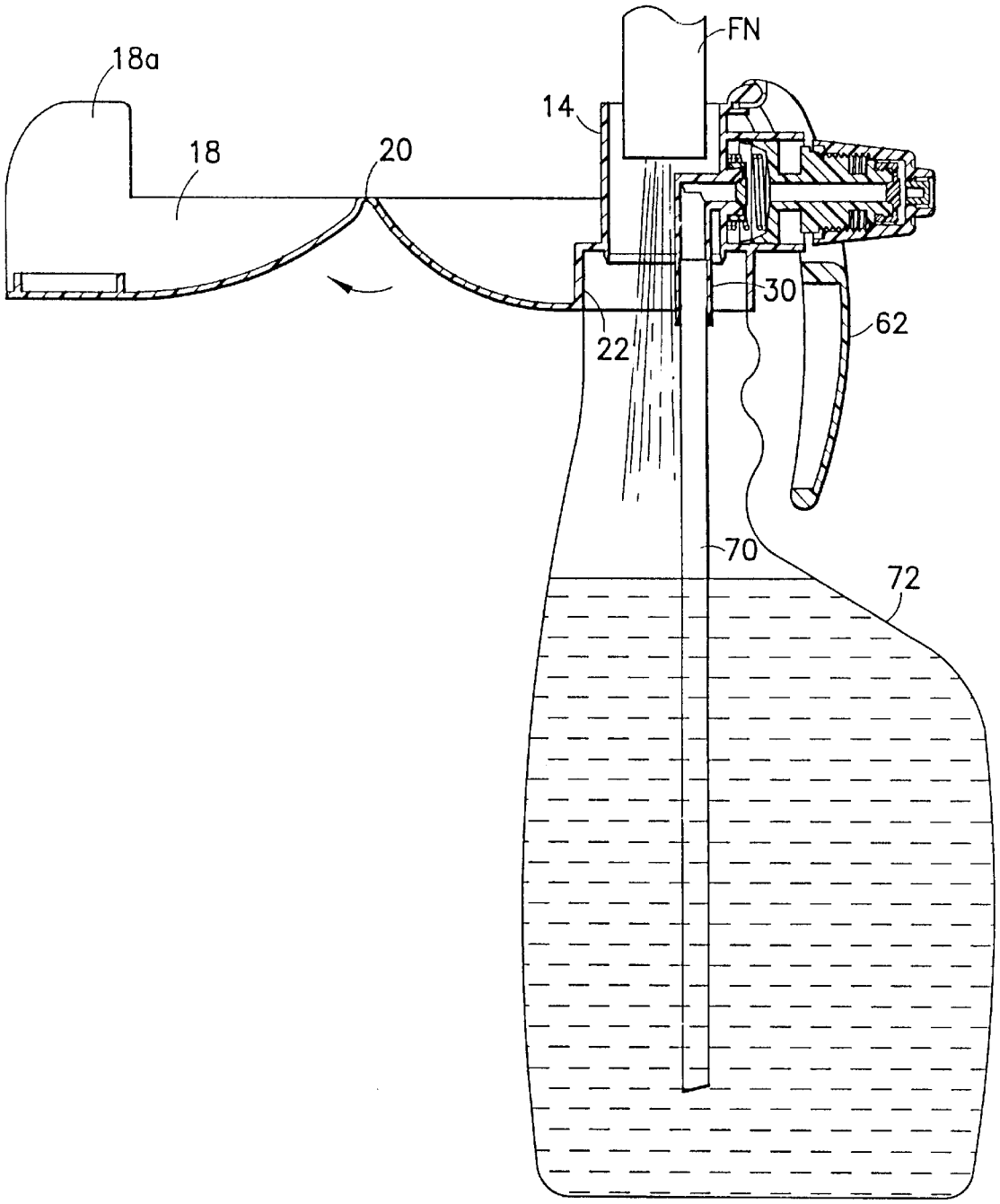
FIG. 3 is a sectional view of a pump body embodying the invention applied to a container shown in outline, the housing/closure of the body shown in open position and the container being filled from a fill nozzle through the pump body.

In assembly, FIG. 3, a dip tube 70 is mounted in the dip tube mount 30 and a container 72 is sealingly connected to the container connector portion 22. The upper portion 18 of the housing is hinged open as shown in FIG. 3, leaving the vertical conduit 14 open at the top. A fill nozzle FN from a source of the liquid product is inserted into the upper end of the vertical conduit 14 and dispenses a measured amount of liquid into the container through the conduit 14. With the flow cut off after the measured amount has been dispensed, the nozzle is withdrawn from the conduit and the upper housing portion 18 is hinged at living hinge 20 up and over the housing portion 16 with the closure 26 firmly applied into the upper end of the vertical fill conduit 14. The closure 26 may be non-removably attached to the conduit as by welding, glue, or one-way snap if desired or necessary. The side wall extensions 18*a* fit snugly against the lower housing portion 16 on opposite sides thereof (not shown).

For the consumer, the pump operates in a conventional way. The consumer holds the assembly with the web of his hand fitting against the neck of the bottle and the lower portion 16 of the housing with fingers repeatedly pulling the trigger lever toward the neck. The pump stroke is short but effective.

As the lever 62 is pulled backward, the notches 25 accommodate the trunions 60. The piston/nozzle unit moves leftward against the force of the spring 46 to pressurize liquid in the cylinder and in the axial opening 38. This forces liquid through the outlet check 54 and into the swirl chamber and out the orifice 51 in the form of a spray cone.

When the consumer releases grip on the trigger lever 62, the spring 46 forces the nozzle/piston unit 32 and cap 50 to extended position. The outlet check 56 being closed as the plug valve moves against its seat, a vacuum is created in the cylinder and axial passage 38, drawing liquid (after a priming stroke, if necessary) up the dip tube 70 and through the mount 30 past the plug 44 and into the cylinder so that the liquid is ready for the next piston stroke.

Outwardly the pump body of the present invention does not suggest its innovative fill-through feature. Very likely the consumer will detect no difference, other than styling, in the embodiments of the invention from pump dispensers she is used to. The vertical fill conduit 14 and closure 26 are undetectable, hidden by the upper housing portion 18.

Figure 4:
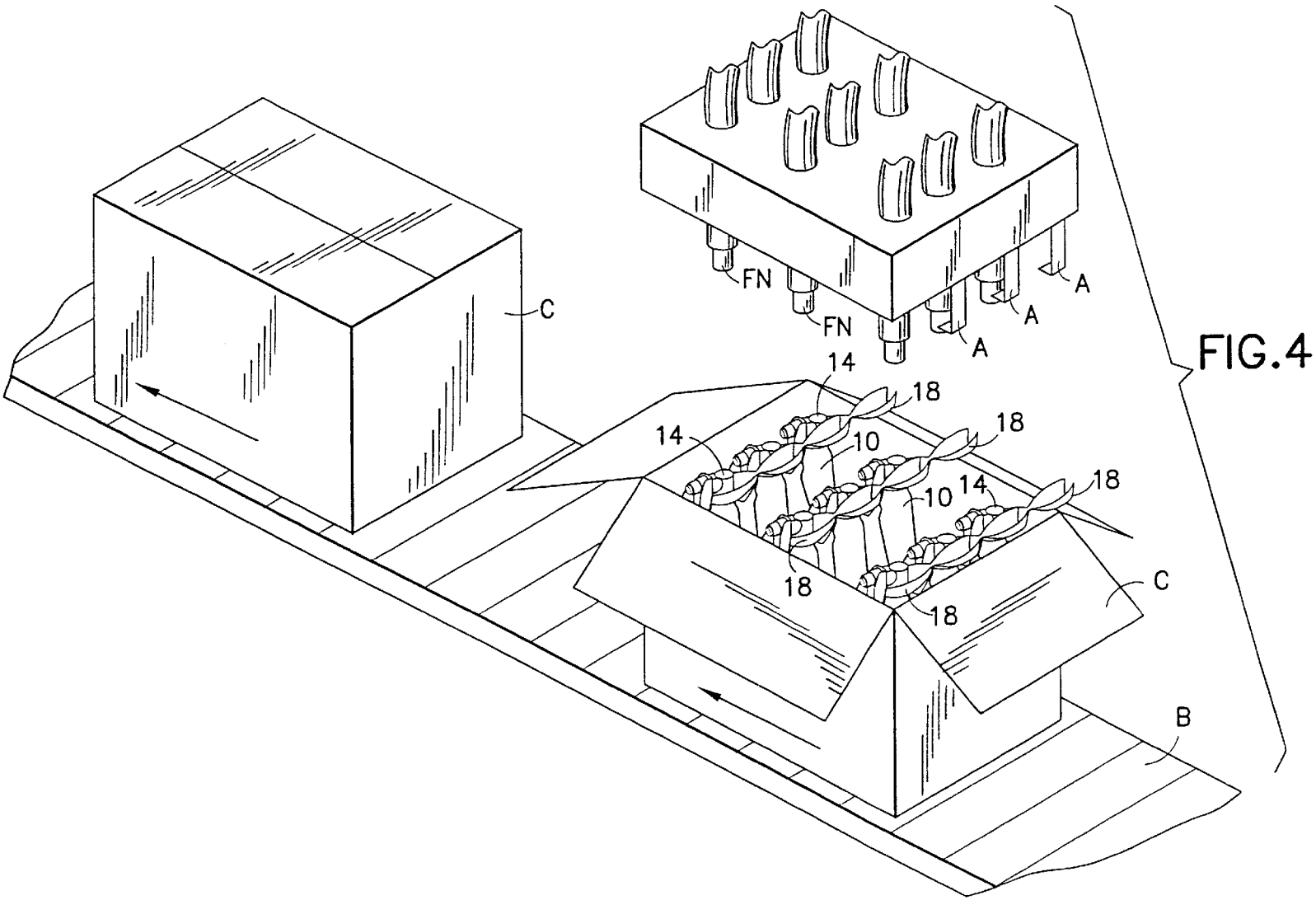
FIG. 4 is a reduced perspective view of a fill line showing an open carton on a conveyor with the dispensers in the carton in open condition. Also shown is a filling and closing head in the process of filling and closing the dispensers.

As a result of the structure described, the packaging and filling of dispensing assemblies may be revolutionary. More specifically, a dozen assemblies 10 as shown in FIG. 3 can be loaded into a carton C (FIG. 4), each assembly with the upper housing portion 18 open as shown. As represented, the carton may be placed on a carton conveyor B and moved continuously to the left as shown in FIG. 4. At a point in the travel of the carton, a filling head having filling nozzles FN pre-positioned in the pattern of the open vertical fill conduits in the carton, can be moved relative to the assemblies so that the fill nozzles FN fit respectively into the conduits 14.

An appropriate supply (not shown) of liquid product can be connected by suitable tubing and valve means to the respective fill nozzles FN to discharge such liquid product into the respective containers up to a desired level. The head can then be withdrawn upward, or the carton can be dropped downwardly by appropriate decline in the conveyor so that the fill nozzles are out of the conduits. Simultaneously, or later, appropriate closing arms A, which may be on the fill head, move under the respective upper housing portions 18 and pivot them about the hinges 20 over the lower housing portions 16 and force the closures 26 onto the conduits 14. The closures having been effected, the flaps on the carton can be coated with adhesive and pivoted closed to provide a finished package ready for shipment and sale.

This procedure takes the place of the procedure used heretofore wherein separate empty containers have been filled individually by filling nozzles as they move along the conveyor and then the dip tube inserted and the pump carefully screwed onto the container. In the old process there has been a possibility of spillage because of misalignment in the difficult procedure of capping the bottle—flexible dip tube end entering first—with a pump assembly. The container is full during the assembly of the pump onto the container in the old practice.

Modifications

Figure 5:
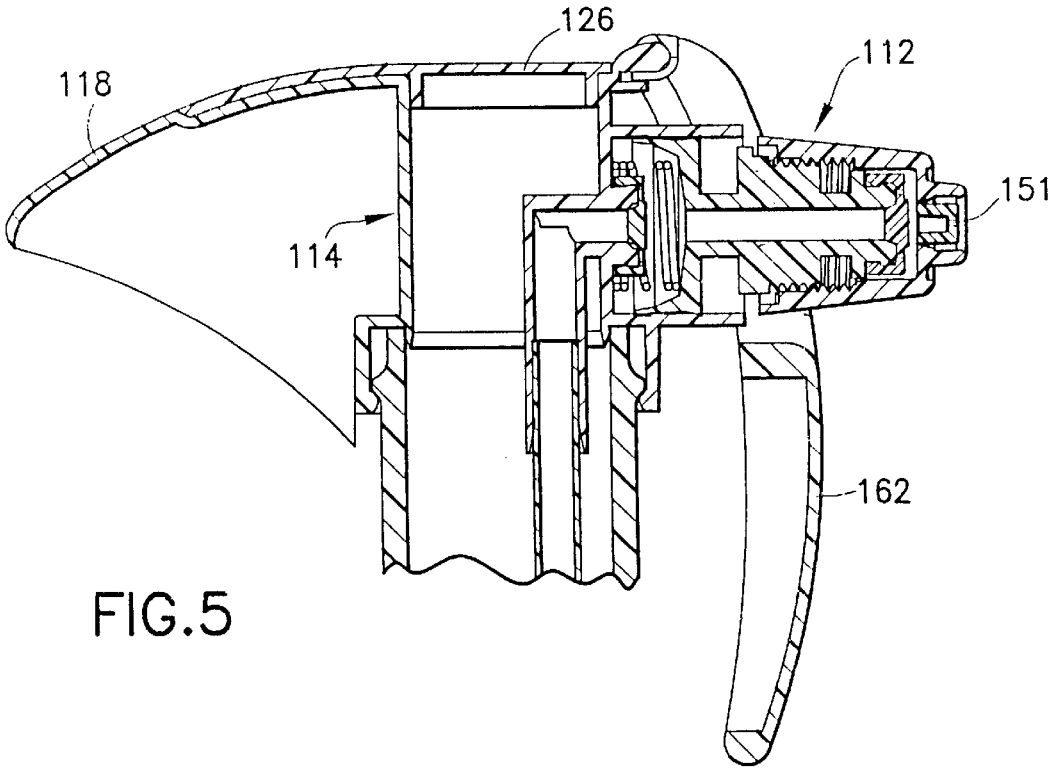
FIG. 5 is a vertical centerline sectional view of a modified form of pump body.

The FIG. 5 modification is essentially the same as the FIG. 1 embodiment with the exception that the closure 126 is a separate piece from the upper housing portion 118. The pump 112 can be the same as in the FIG. 1 embodiment.

Figure 6:
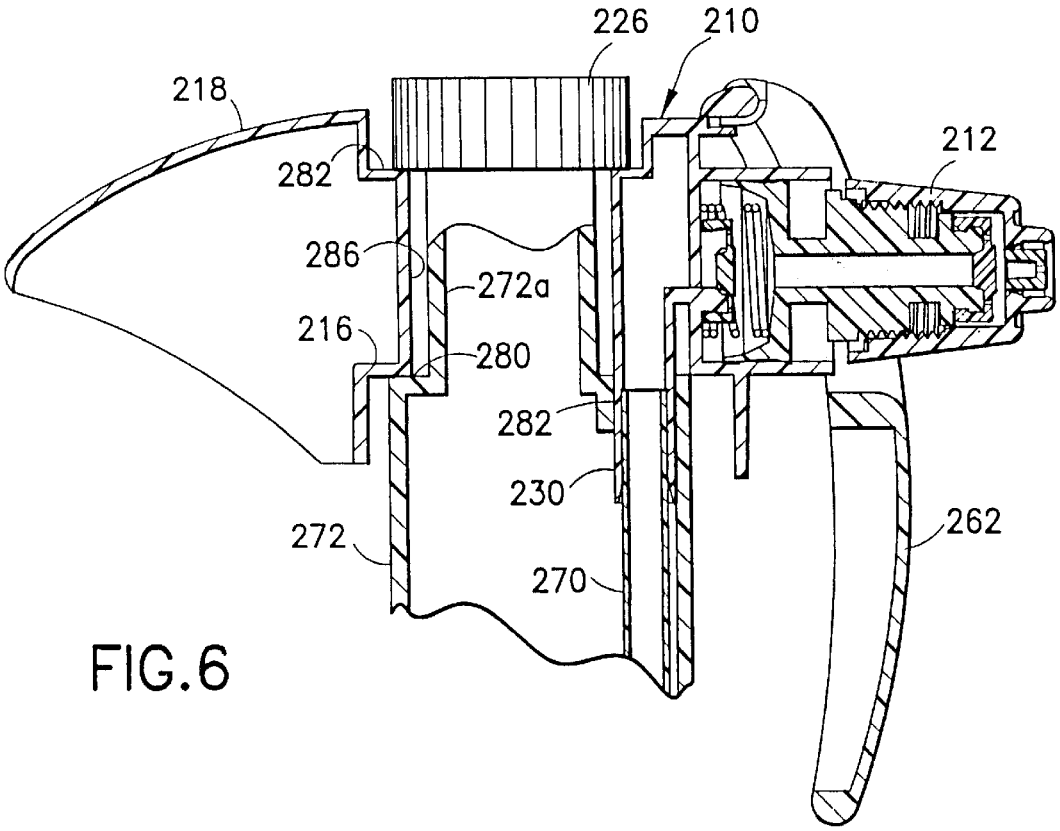
FIG. 6 is a vertical centerline sectional view of a further modified form of dispenser.

In the FIG. 6 modification, the container 272 is formed with a neck 272*a* which takes the place of the vertical fill conduit 14 of the preferred embodiment and is equivalent thereto. The neck 272*a* passes through an opening 286 in the dispenser body. Spaced down from the mouth of the container 272 an annular shoulder 280 is formed which is engaged by a lower housing portion 216 of the pump body. A closure 226 snaps or screws onto the mouth of the neck 272*a* and forcefully engages an upwardly facing shoulder 282 on the upper housing portion 218 of the body. This clamping engagement holds the body 210 securely down in place on the container 272.

The container 272 is provided with a second opening 282 at the level of the shoulder 280 to permit sealed passage into the container of the dip tube 270 and dip tube mount 230.

Filling of the containers in the FIGS. 5 and 6 embodiments is practiced in the same way as in the preferred FIG. 1 embodiment. Namely, with the closure 126 or 226 removed, a fill nozzle is inserted in the respective conduit 114 or 272*a*. When the discharge from the fill nozzle is complete, the fill nozzle is withdrawn and the closure 126 or 226 is reapplied. Operation of the pumps of the modification is as with the preferred embodiment.

Vent means for the container and pump of the embodiments disclosed are not shown. Such means are well-known in the art.

Variations in the invention are possible. For instance, a variety of hinge arrangements for the upper housing portion are envisioned. Appearance modifications and different pump configurations are possible. It is also contemplated to replace the diptube with a so-called bag-in-the-bottle as well known in the art, wherein the bag is filled and connected directly to the pump which, of course, would have no diptube or vent.

Thus, while the invention has been shown in only limited embodiments, it is not so limited but is of a scope defined by the following claim language which may be broadened by an extension of the right to exclude others from making, using or selling the invention as is appropriate under the doctrine of equivalents.

What is claimed is:

1. A process for filling and closing a plurality of hand held dispensing assemblies including the steps of:

a. providing a plurality of said assemblies each comprising 1) a container 2) a pump body having a housing comprising hinged upper and lower portions and supported on the container and defined by a forward manually operated pump having a dip tube extending into the container and a rearward vertical fill conduit for supply liquid to the container and terminating in an upper end and having a lower end connected to the container, and 3) a closure comprising part of the upper portion of the pump housing for closing the upper end of the conduit, b. grouping the assemblies with the upper ends of the conduits in a pre-determined array with the closures removed and the upper portions of the housing hinged open, c. providing a filling head having a plurality of downward nozzles arranged in the same array as the upper ends of the conduits, d. causing the group of assemblies and the filling head to assume a filling position in which the respective nozzles extend into the respective upper ends of the conduits, e. filling the respective containers with supply liquid through the nozzles into the conduits, f. withdrawing the filling nozzles, and g. hinging the upper portions of the housings closed to install the closures onto the upper ends of the conduits.

2. A process as claimed in claim 1 wherein the conduits are necks of the respective containers.

3. A process for filling and closing a dispensing assembly including:

1) a container 2) a pump body having a housing comprising hinged upper and lower portions and supported on the container and defined by a forward manually operated pump portion having a dip tube extending into the container and a rearward vertical fill conduit for supplying liquid to the container and terminating in an upper end and having a lower end connected to the container, and 3) a closure comprising part of the upper portion of the pump housing for closing the upper end of the conduit, the process including the steps of a. preparing the assembly with its closure removed and the upper portions of the housing hinged open, b. providing a filling head having a downward fill nozzle, c. causing the assembly and the filling head to assume a filling position in which the nozzle extends into the upper end of the fill conduit, d. filling the container through the nozzles into the fill conduit to the container, e. withdrawing the filling nozzle, and g. hinging the upper portion of the housing closed to install the closure to the upper end of the conduit.

4. A process as claimed in claim 3 including the additional step of assuring that the installation of the closure is non-removable.

* * * * *